US007958831B2

(12) United States Patent
Campus

(10) Patent No.: US 7,958,831 B2
(45) Date of Patent: Jun. 14, 2011

(54) LATERAL FACE OF A RAIL VEHICLE BODY

(75) Inventor: Emigliano Campus, Yves (FR)

(73) Assignee: Alstom Transport SA, Levallois-Perret (FR)

( * ) Notice: Subject to any disclaimer, the term of this patent is extended or adjusted under 35 U.S.C. 154(b) by 0 days.

(21) Appl. No.: 11/809,082

(22) Filed: May 31, 2007

(65) Prior Publication Data

US 2008/0011188 A1 Jan. 17, 2008

(30) Foreign Application Priority Data

Jun. 2, 2006 (FR) ..... 06 04957

(51) Int. Cl.
*B61D 25/00* (2006.01)

(52) U.S. Cl. ..... 105/396; 105/404; 296/186.1

(58) Field of Classification Search ..... 105/396, 105/404, 409; 296/186.1, 191, 203.01, 203.03, 296/186.2, 178

See application file for complete search history.

(56) References Cited

U.S. PATENT DOCUMENTS

| | | | | | |
|---|---|---|---|---|---|
| 3,774,553 | A * | 11/1973 | Kunst et al. | 105/401 |
| 4,634,167 | A * | 1/1987 | Moriki et al. | 296/76 |
| 4,974,900 | A * | 12/1990 | Destefani et al. | 296/181.6 |
| 5,042,395 | A * | 8/1991 | Wackerle et al. | 105/397 |
| 5,218,799 | A * | 6/1993 | Appino | 52/213 |
| 5,333,554 | A * | 8/1994 | Yamada et al. | 105/397 |
| 5,383,406 | A * | 1/1995 | Vanolo et al. | 105/401 |
| 5,433,151 | A * | 7/1995 | Ohara et al. | 105/397 |
| 5,685,229 | A * | 11/1997 | Ohara et al. | 105/397 |
| 5,797,646 | A * | 8/1998 | Jeunehomme et al. | 296/193.03 |
| 6,234,084 | B1 * | 5/2001 | Neubauer et al. | 105/396 |
| 6,302,031 | B1 * | 10/2001 | Smith et al. | 105/404 |
| 6,378,444 | B1 * | 4/2002 | Dastas et al. | 105/396 |
| 6,454,345 | B1 * | 9/2002 | Campus | 296/203.01 |
| 6,669,266 | B1 * | 12/2003 | Pugh et al. | 296/146.11 |
| 6,685,254 | B2 * | 2/2004 | Emmons et al. | 296/178 |
| 6,986,546 | B2 * | 1/2006 | Ehrlich | 296/191 |
| 7,036,870 | B2 * | 5/2006 | Nieminski et al. | 296/178 |

(Continued)

FOREIGN PATENT DOCUMENTS

DE 1900649 U 9/1964

(Continued)

OTHER PUBLICATIONS

Duba, "Konstructive Voraussetzungen Fuer Die Rationelle Fertigung Des Modernen U-Bahn-Und Stadtbahnwagens" Lechtbau Der Verkehrsfahrzeuge, Hamburg Germany Nov. 29, 1968 pp. 188 to 192. See French Search Report.

*Primary Examiner* — S. Joseph Morano
*Assistant Examiner* — Jason C Smith
(74) *Attorney, Agent, or Firm* — Davidson, Davidson & Kappel, LLC

(57) ABSTRACT

A lateral face of a rail vehicle body is provided including a framework which is formed by an assembly of a plurality of adjacent panels and an outer skin which is adhesively-bonded to the framework and which extends over at least two adjacent panels, the assembly of panels and the skin forming a laminated assembly, each panel including ribs which are arranged so as to ensure the vertical rigidity and the horizontal rigidity of the lateral face. The outer skin extends over the entire length of the lateral face.

18 Claims, 8 Drawing Sheets

U.S. PATENT DOCUMENTS

| | | | | |
|---|---|---|---|---|
| 7,210,413 | B2 * | 5/2007 | Barry et al. | 105/404 |
| 2002/0024235 | A1 * | 2/2002 | Campus | 296/203.01 |
| 2002/0053811 | A1 * | 5/2002 | Myers | 296/100.02 |
| 2004/0089194 | A1 * | 5/2004 | Homes | 105/404 |
| 2005/0066506 | A1 * | 3/2005 | Campus et al. | 29/428 |
| 2005/0134086 | A1 * | 6/2005 | Jones et al. | 296/186.1 |
| 2005/0161975 | A1 * | 7/2005 | Nieminski et al. | 296/178 |
| 2006/0028050 | A1 * | 2/2006 | Ehrlich | 296/186.1 |
| 2006/0065152 | A1 * | 3/2006 | Heitmeyer et al. | 105/404 |
| 2007/0284913 | A1 * | 12/2007 | Ehrlich | 296/186.1 |
| 2008/0011188 | A1 * | 1/2008 | Campus | 105/401 |

FOREIGN PATENT DOCUMENTS

| | | |
|---|---|---|
| WO | WO 02/58981 A1 | 1/2002 |

* cited by examiner

LATERAL FACE OF A RAIL VEHICLE BODY

This claims the benefit of French Patent Application No. 06 04957, filed on Jun. 2, 2006 and hereby incorporated by reference herein.

TECHNICAL FIELD

The present invention relates to a lateral face of a rail vehicle body which includes at least one opening of the window or door type.

BACKGROUND TO THE INVENTION

Rail vehicles, and in particular carriages which are intended to accommodate passengers, comprise a body which includes a floor, a roof, two end walls and two lateral walls. The lateral walls comprise openings which are intended, on the one hand, to receive doors and, on the other hand, to receive windows. The arrangement and the number of windows of the carriages may vary from one model to another.

In order to produce the body of a rail vehicle, it is known to produce panels which include the floor, the roof or the lateral walls in one piece and which are of the length of the whole of the body of the carriage.

This technique has the disadvantage of requiring equipment which is suitable for each length of rail vehicle.

Other methods are also known which involve producing modular lateral faces by assembling panels which include profile-sections having hollow compartments. These profile-sections comprise an inner wall and an outer wall which are connected by means of cross-members which form channels having a triangular or square cross-section. Panels of this type have the disadvantage of being difficult to shape, in particular in order to be curved. Furthermore, the strengthening cross-members are unidirectional and are either parallel with the carriage floor or perpendicular relative thereto. Furthermore, the connection between the two successive panels may present problems in terms of sealing.

Methods for producing lateral walls of rail vehicles are also known which involve producing a framework which includes horizontal beams which are of the length of the body of the rail vehicle and a grid which includes beams which extend over the height of the lateral wall of the rail vehicle, this structure being covered by an outer skin. This technique has the disadvantage of requiring the use of very long beams.

SUMMARY OF THE INVENTION

An object of the present invention is to provide a method for constructing rail vehicle body lateral walls which are modular, which provide a good level of both longitudinal and transverse rigidity for the wall and which further provides good sealing for the lateral wall.

The present invention provides a lateral face of a rail vehicle body, including a framework which is formed by an assembly of a plurality of adjacent panels and an outer skin which is adhesively-bonded to the framework and which extends over at least two adjacent panels, the assembly of panels and the skin forming a laminated assembly, each panel including ribs which are arranged so as to ensure the vertical rigidity and the horizontal rigidity of the lateral face and the outer skin extends over the entire length of the lateral face.

Preferably, each panel may extend over the entire height of the lateral face.

The lateral face of the rail vehicle body may include at least one opening of the window or door type, delimited by a surround which includes horizontal and vertical ribs of a single panel or two adjacent panels whose connection is located remote from the zones of concentrated stress corresponding to the corners of the surround of the opening. The lateral face of the rail vehicle body may include at least one glazed panel for closing a window.

Preferably, the connection of two adjacent panels may be brought about by means of mutually complementary vertical ribs or rib portions which are provided on the vertical edges of the panels.

Preferably, at least one rib extends in a diagonal line over at least a portion of a panel in order to include a triangular reinforcement.

At least one panel may include at least one recess which is intended to form a portion of a window. Preferably, the ribs may include a core which includes a lateral pillar of at least one window and at least one rib which extends in a diagonal line from the core to the upper edge of the panel and at least one rib which extends in a diagonal line from the core to the lower edge of the panel.

The lateral panel may include two recesses which are intended to form two half-windows and the ribs form at least one X-shaped reinforcement structure including a core which includes a lateral pillar common to the two half-windows.

At least one panel may include at least one opening through a space which is delimited by the ribs, the opening being concealed by the outer skin.

The lateral face of a rail vehicle body may further include at least one horizontal longitudinal beam which is secured to the outer skin and which extends in an opening which is delimited by ribs and which is fixedly joined to the outer skin and the panel including the opening.

At least one panel may be a ribbed shell whose ribs together delimit at least one cell, of which at least one can receive a thermal and/or acoustic insulation material.

The lateral face of the rail vehicle body may include, at the inner side thereof, a closing and covering skin.

At least one panel may be intended to receive a door, the ribs including at least the lateral pillars of the door.

At least one network of the type involving a ventilation or heating sheath, electrical cables or fluid distribution, may be received in a space delimited by the outer skin and at least one rib of at least one panel.

At least one panel may include a plate of composite material of the type including a network of fibres which is impregnated with a resin, shaped by means of moulding, or may include a cut and pressed metal plate.

The outer skin may be, for example, a sheet which is cut in order to form the openings, and which is composed of composite material, plastics material, or metal.

The panels and/or the outer skin may be assembled, for example, by means of adhesive-bonding, riveting, bolting, adhesive-bonding and riveting, adhesive-bonding and bolting, clinching or welding.

The invention also provides a rail vehicle, for example, of the carriage type, including a body, of which at least one lateral face of the body is in accordance with the invention.

The invention further provides a panel for the production of a lateral wall of a rail vehicle body according to the invention which includes, for example, a cut and pressed metal plate or a plate of composite material, for example, of the type including a network of fibres impregnated with a resin, shaped by means of moulding.

BRIEF DESCRIPTION OF THE DRAWINGS

The invention will now be described in a more precise but non-limiting manner, with reference to the appended Figures, in which.

DESCRIPTION OF PREFERRED EMBODIMENTS

Figure 1:
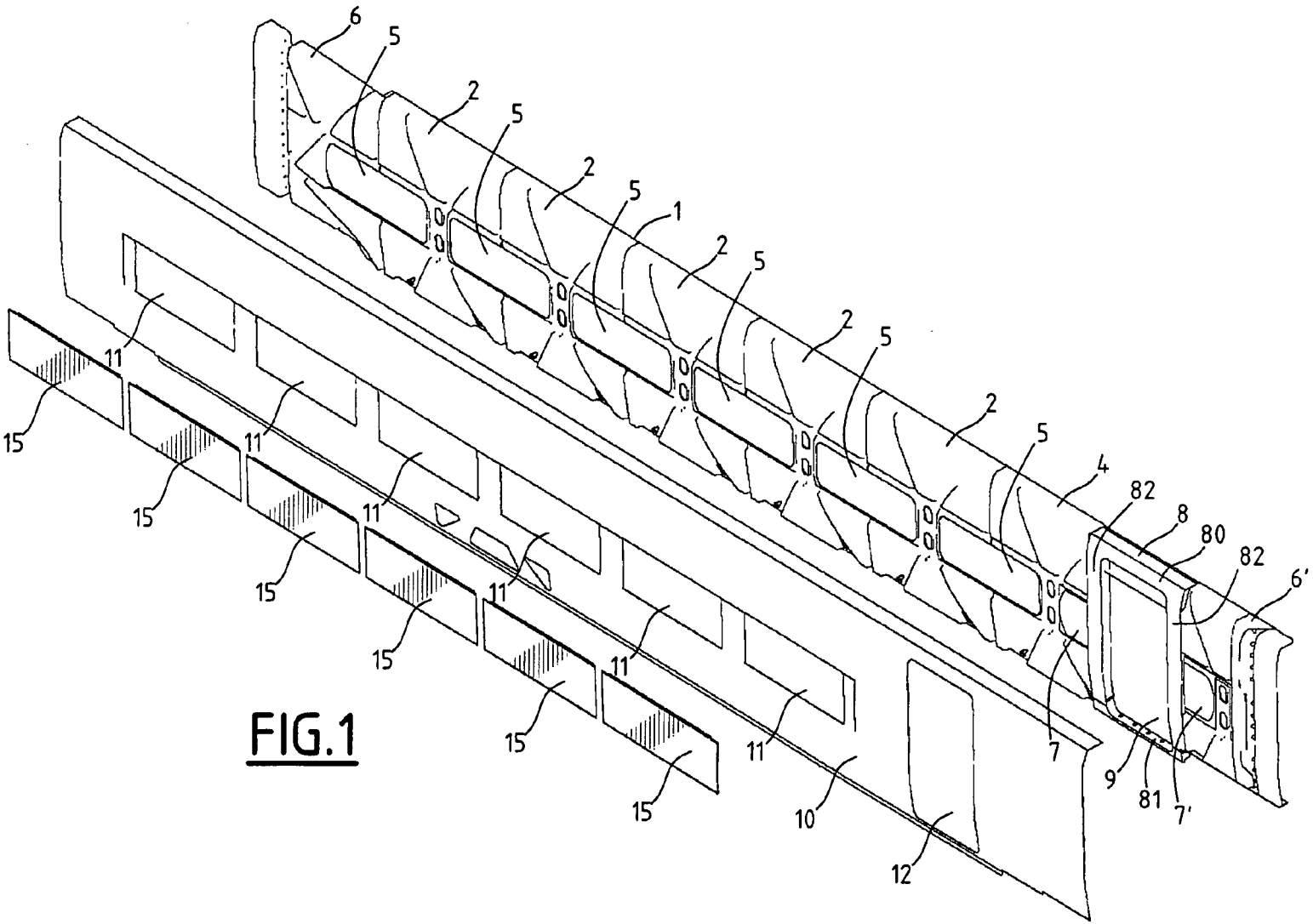
FIG. 1 is a partially exploded perspective view of the lateral wall of the body of a rail vehicle, viewed from the outer side of the body of the vehicle.
Figure 2:
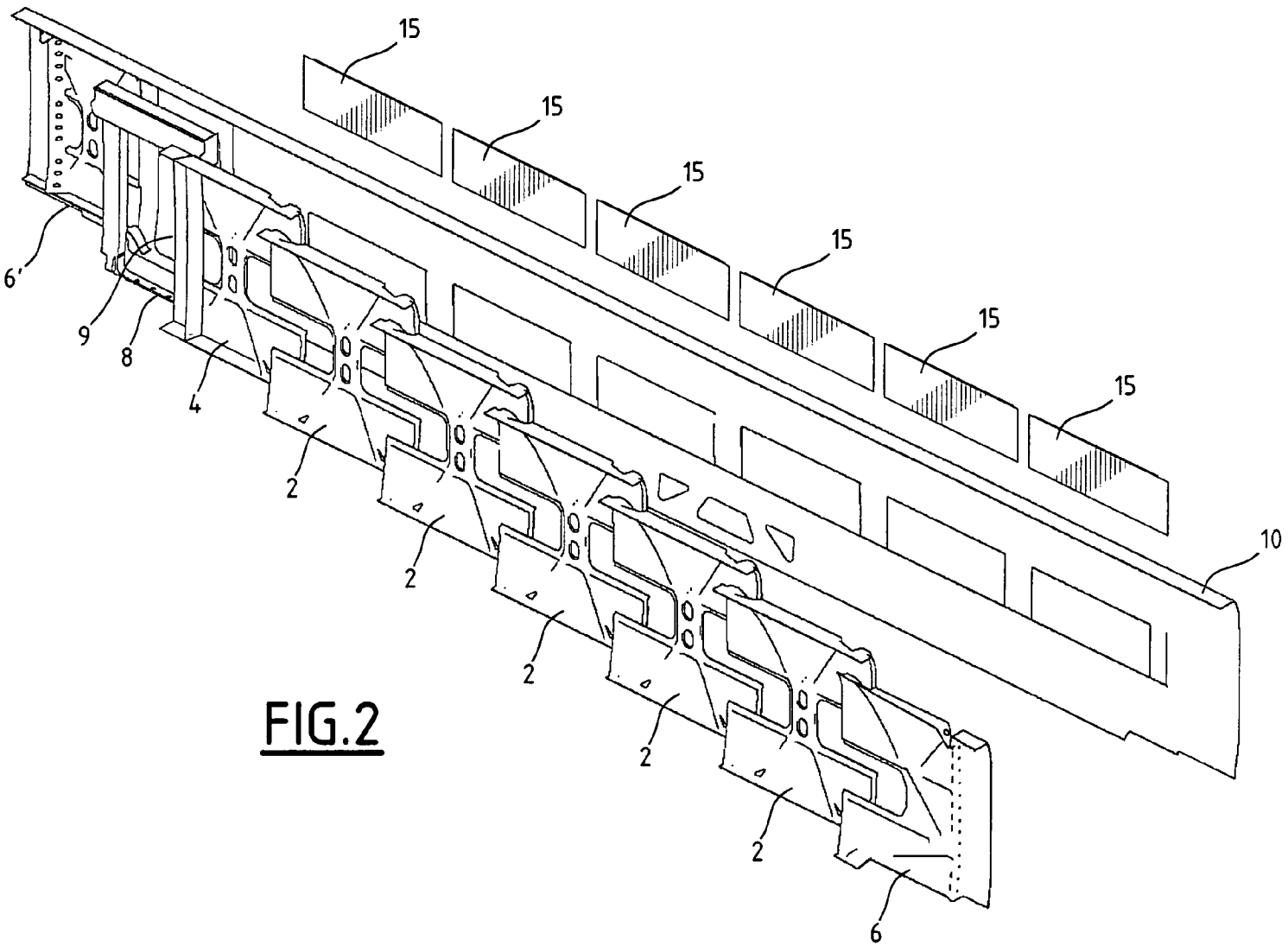
FIG. 2 is an exploded perspective view of the lateral face of the body of a rail vehicle, viewed from the inner side of the body of the vehicle.

The rail vehicle body lateral face which is illustrated as an exploded view in FIG. 1 and FIG. 2, includes, on the one hand, an inner framework 1 and, on the other hand, an outer skin 10 which is intended to be attached to the inner framework 1 in order to form a laminated assembly. This lateral face is complemented by glazed panels 15 which are fixed to the lateral face in order to close the openings which include the windows.

The framework 1 includes a plurality of panels which are juxtaposed and fixed together in order to form a continuous assembly. These panels are, on the one hand, panels of the type involving central panels 2, which correspond to the central portion which extends over the main part of the length of the lateral face of the rail vehicle body, end panels 6 and 6' which are arranged at the two ends of the lateral face of the rail vehicle body, a panel 8 which is intended to receive a door and which includes a door opening 9, and an intermediate panel 4 for connection between a central panel 2 and a panel 8 which is intended to receive a door.

The central panels 2 and a first end panel 6 include recesses which delimit, on the framework 1, generally elongate rectangular openings 5 which are intended to form the apertures for the windows of the body of the rail vehicle.

The intermediate panel 4 and the second end panel 6' which surround the door also include recesses which form in the shell 1 openings 7 and 7' which are smaller than the windows 5 of the central portion of the lateral panel. In the example illustrated in FIG. 1, these openings 7 and 7' are concealed by the outer skin 10.

The outer skin 10 includes a thin continuous wall which is intended to cover the whole of the surface-area of the lateral face of the body of the rail vehicle. The outer skin 10 includes rectangular openings 11 facing the rectangular openings 5 of the inner framework which are intended to form windows. The outer skin 10 also includes an opening 12 facing the opening 9 of the panel 8 which is intended to receive a door of the lateral face of the body of the rail vehicle.

When the outer skin 10 is attached to the inner framework 1, glazed panels 15 are arranged on the skin facing openings 11 in order to close all of the windows of the lateral face of the body of the rail vehicle. The glazed panels 15 can be fixed by means of adhesive-bonding or using any other fixing means known to the person skilled in the art.

The outer skin 10 may include a metal plate, for example, of thin aluminium or steel, shaped so as to have curvature which corresponds to the curvature desired for the lateral face of the rail vehicle body, and also including the openings which are intended to form the windows and the door. The outer skin 10 may also include a plate of composite material which is reinforced with fibres, which is thin and which includes cut-outs which correspond to the openings. The skin may further include a sheet which includes cut-outs which are suitable for producing openings of the lateral face of the rail vehicle body. This outer skin is thin and is adhesively-bonded to the inner framework 1 in order to form a sealed and very rigid assembly.

The inner framework 1 is, as set out, includes panels which will be described in greater detail below. Each of these panels includes ribs which are intended to provide the rigidity thereof. In particular, with the exception of the panel 8 which is intended to receive a door, the panels include ribs in a diagonal line on the lower and upper portions thereof which provide rigidity, both in the direction of the length and in the transverse direction. These panels include a plate of a composite material or of metal, shaped in order to form hollow ribs which delimit cells. The ribs are formed so as to protrude on the inner side of the lateral face of the body of the rail vehicle, in such a manner that the outer skin comes into contact with the base of the cells which are delimited by the ribs. The bases of the cells form relatively large surfaces which allow good adhesive-bonding of the outer skin 10 to the inner framework 1.

The panel 8 which is intended to receive a door, includes an upper horizontal rib 80 which forms the lintel, a lower horizontal rib 81 which forms the threshold of the door and two vertical ribs 82 which include the pillars of the door and which are suitable for providing the connection to the adjacent panels 4 and 6'.

These panels include shells whose wall is thin and solid.

When the panels are produced from plastics material or composite material, such as, for example, a fabric of glass fibre impregnated with resin, the panels are produced by means of moulding.

When these panels are of metal, and, for example, of aluminium, they may be produced by means of cutting and pressing.

Figure 3:
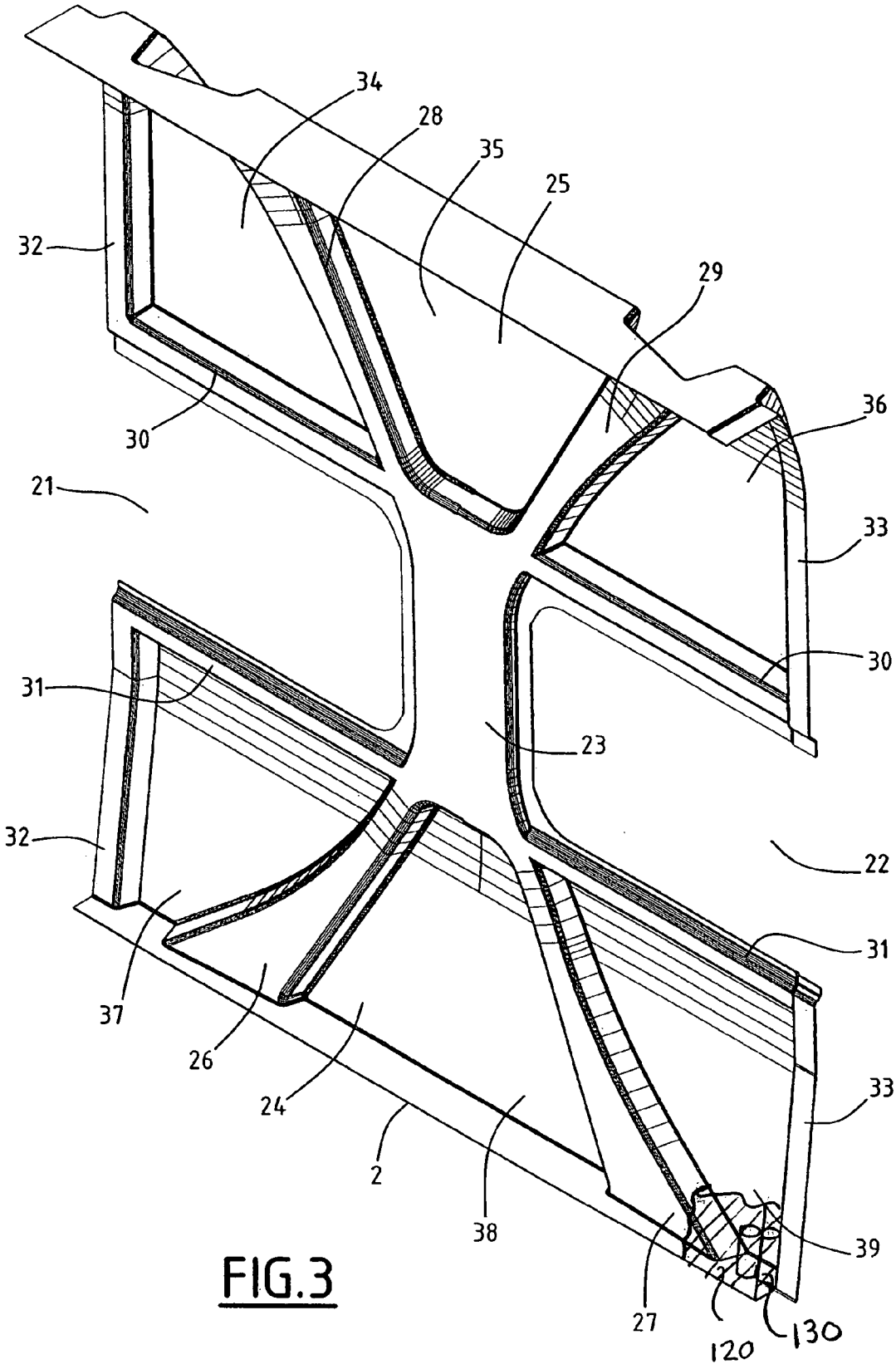
FIG. 3 is a perspective view, viewed from the inner side, of a ribbed panel which is intended for the production of a lateral face of a rail vehicle body.

A central panel 2 will now be described. A panel of this type, which is illustrated in FIG. 3, includes, at mid-height, two recesses 21 and 22 which correspond to two half-windows which are separated by means of a rib which forms a core 23. The panel 2 includes, at the lower portion thereof, a lower semi-panel 24 and, at the upper portion thereof, an upper semi-panel 25, these two semi-panels, the lower one and the upper one, being connected by the core 23.

The lower semi-panel 24 and upper semi-panel 25 are solid portions which include an assembly of strengthening ribs. These strengthening ribs are, for the lower semi-panel 24, two branches 26 and 27 in a diagonal line which extend from the core 23 to a location near the lower corners of the lower semi-panel 24 and, for the upper semi-panel 25, two branches 28 and 29 which extend in a diagonal line from the core 23 to each of the corners or to a location near each of the corners of the upper semi-panel 25. These ribs form an X-shaped reinforcement structure which has the advantage of providing good rigidity both in the longitudinal direction and in the transverse direction whilst allowing the structure as a whole to remain light.

Furthermore, the assembly of reinforcement ribs of the panel 2 includes, on the one hand, upper ribs 30 which surround the half-windows, and lower ribs 31 which surround the half-windows. The upper ribs 30 and lower ribs 31 and the core 23 form ribs which surround the half-window 21 or 22.

The vertical ends of the panel 2 also include vertical ribs 32 at one of the ends and ribs 33 at the other end (that is to say, ribs or rib portions), the ribs of one of the ends having a shape which complements the ribs of the other end, so that the ribs of one end of a panel are able to co-operate with the ribs of the other end of an adjacent panel in order to allow the connection between two adjacent panels. Two adjacent panels are fixed to each other by means of adhesive-bonding, riveting, bolting, adhesive-bonding and riveting, adhesive-bonding and bolting, clinching, or welding, depending on the type of material from which the panels are made and depending on the embodiment desired for the lateral face of the rail vehicle body. Any suitable fixing means known to the person skilled in the art can be used.

The ribs together delimit cells 34, 35, 36, 37, 38, 39 whose concavities face the inner side of the rail vehicle body. These cells can receive thermally or phonically insulating materials 130, for example, rock wool or felt, or any other material known to the person skilled in the art. The cells can be closed by one inner covering wall 120 which can be arranged on the inner face of the lateral face of the rail vehicle body when the inner covering wall 120 is mounted.

The ribs, in particular the ribs 23, 26, 27, 28 and 29 which form an X-shaped structure, are closed by the outer skin of the lateral face of the body of the rail vehicle. The ribs thus include conduits which are able to receive ventilation sheaths or heating sheaths or fluid distribution circuits or cables for electrical distribution or for transmitting any type of signal.

A panel 4 will now be described for connection between a panel 8 which is intended to receive a door and a central panel 2 of a rail vehicle body lateral face.

Figure 5:
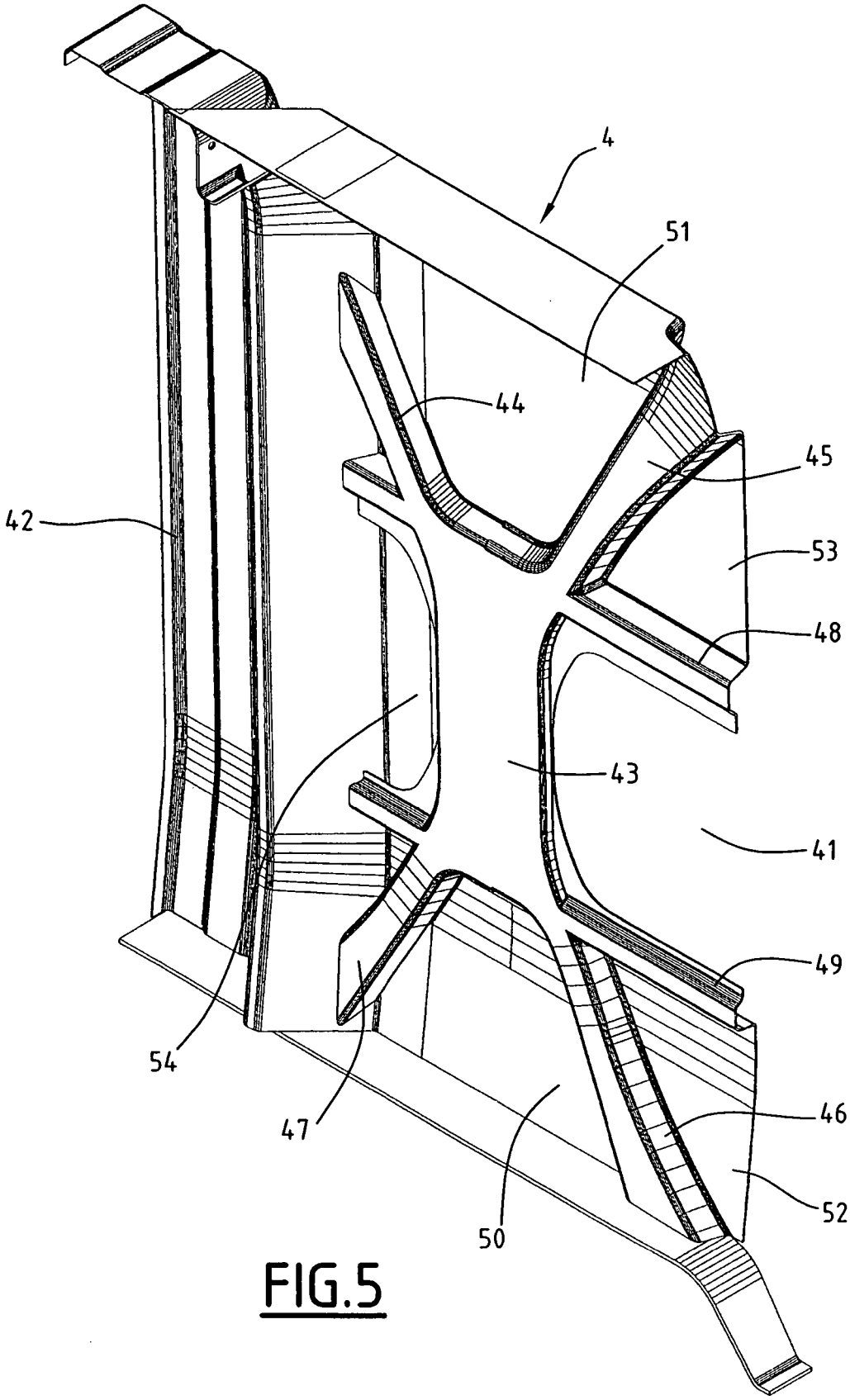
FIG. 5 is a perspective view, viewed from the inner side, of a ribbed panel which is intended to produce a lateral face of a rail vehicle body, in the region of a door.

The connection panel 4, illustrated in FIG. 5, includes a single recess 41 which is intended to complement a window by being connected to a panel of the central panel type. It also includes, on one of the lateral ends thereof, a vertical rib 42 which is intended to co-operate with a lateral pillar of the panel 8 which is intended to receive a door. It finally includes an assembly of strengthening ribs which includes, on the one hand, a window edge core 43 and, on the other hand, diagonal rib elements 44, 45, 46 and 47 for strengthening the upper and lower portions of the panel, and ribs 48 and 49 for strengthening the upper and lower horizontal edges of the recess 41.

As in the above case, the ribs together delimit cells 50, 51, 52, 53, 54 which can receive thermally or phonically insulating materials.

Figure 4:
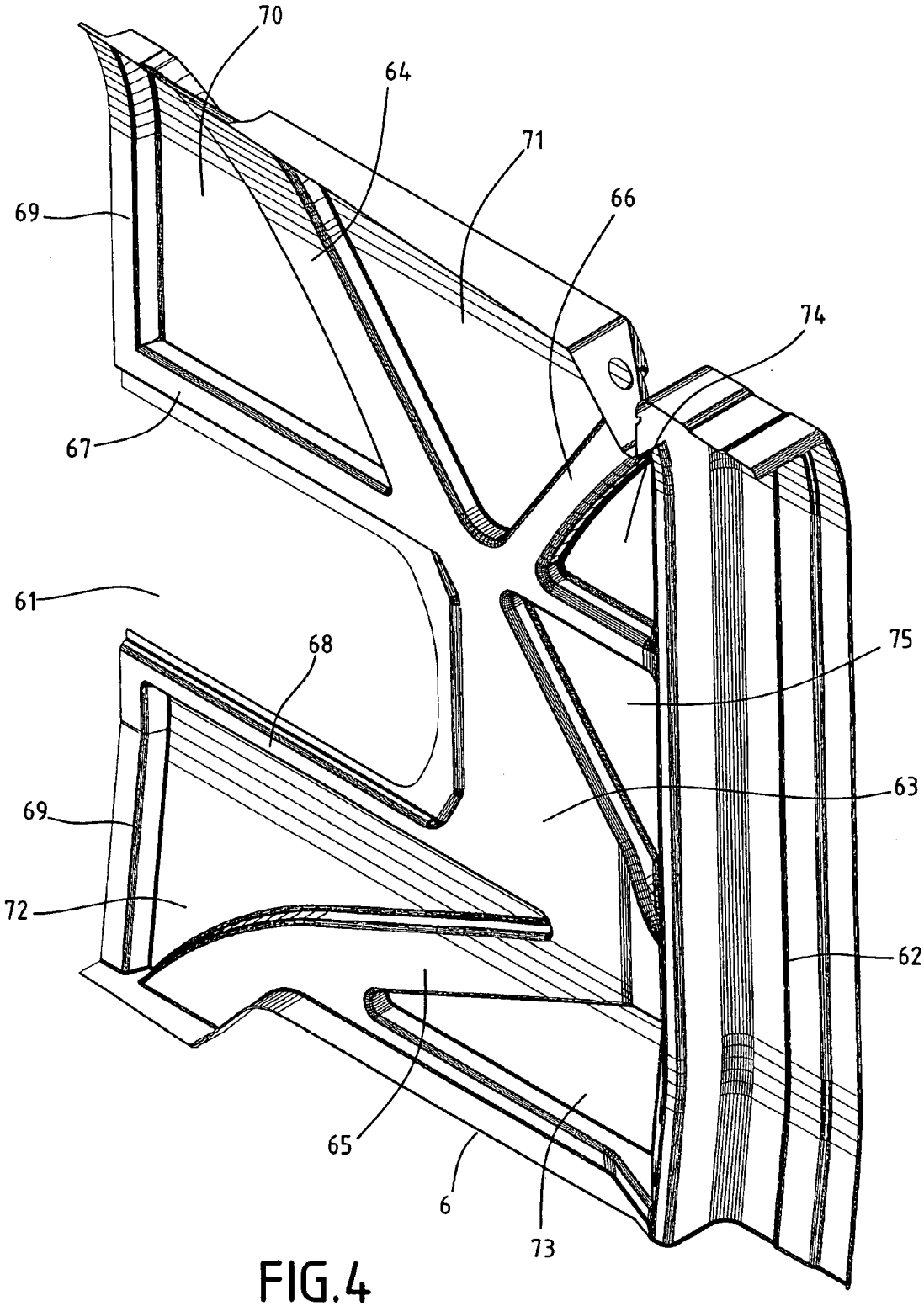
FIG. 4 is a perspective view, viewed from the inner side, of a ribbed panel which is intended to produce an end of a lateral face of a rail vehicle body.

An end panel 6 of a rail vehicle body lateral face will now be described. This panel 6, which is illustrated in FIG. 4, includes a single recess 61 which is intended to form a half-window and, opposite this recess, a vertical rib 62 which has a suitable shape to be able to co-operate with an end structure of a rail vehicle body (not illustrated). The recess 61 is surrounded by the wall of the panel 6 which includes an assembly of upper ribs 63 and lower ribs 64 which extend in a diagonal line and which are complemented by secondary strengthening ribs 65 which extend between the recess 61 and the vertical end rib 62. The panel also includes ribs 66 and 67 for strengthening the upper and lower portion of the recess 61, respectively.

Finally, on the edge of the panel opposite the rib which is intended to co-operate with a body end structure, the panel includes vertical ribs or rib portions 68 and 69 which extend, on the one hand above and, on the other hand, below the recess 61. These vertical ribs 68 and 69 are intended to co-operate with complementary ribs of a central panel.

As in the above case, the ribs together delimit cells or chambers 70, 71, 72 and 73, 74 and 75 which can receive sheets of thermally or phonically insulating material.

These panels are intended, as in the above case, to be assembled with adjacent panels in order to complete the shape of the rail vehicle. It should be noted that it may be necessary to design left-hand panels and right-hand panels depending on whether a left-hand lateral face or a right-hand lateral face of a rail vehicle body is being produced. However, the person skilled in the art knows how to adapt the shape of these panels to the structure he wishes to produce.

The panel 8 which is intended to receive a door includes only ribs which are intended to form the lateral pillars, the threshold and the upper cross-member of the door.

Figure 6:
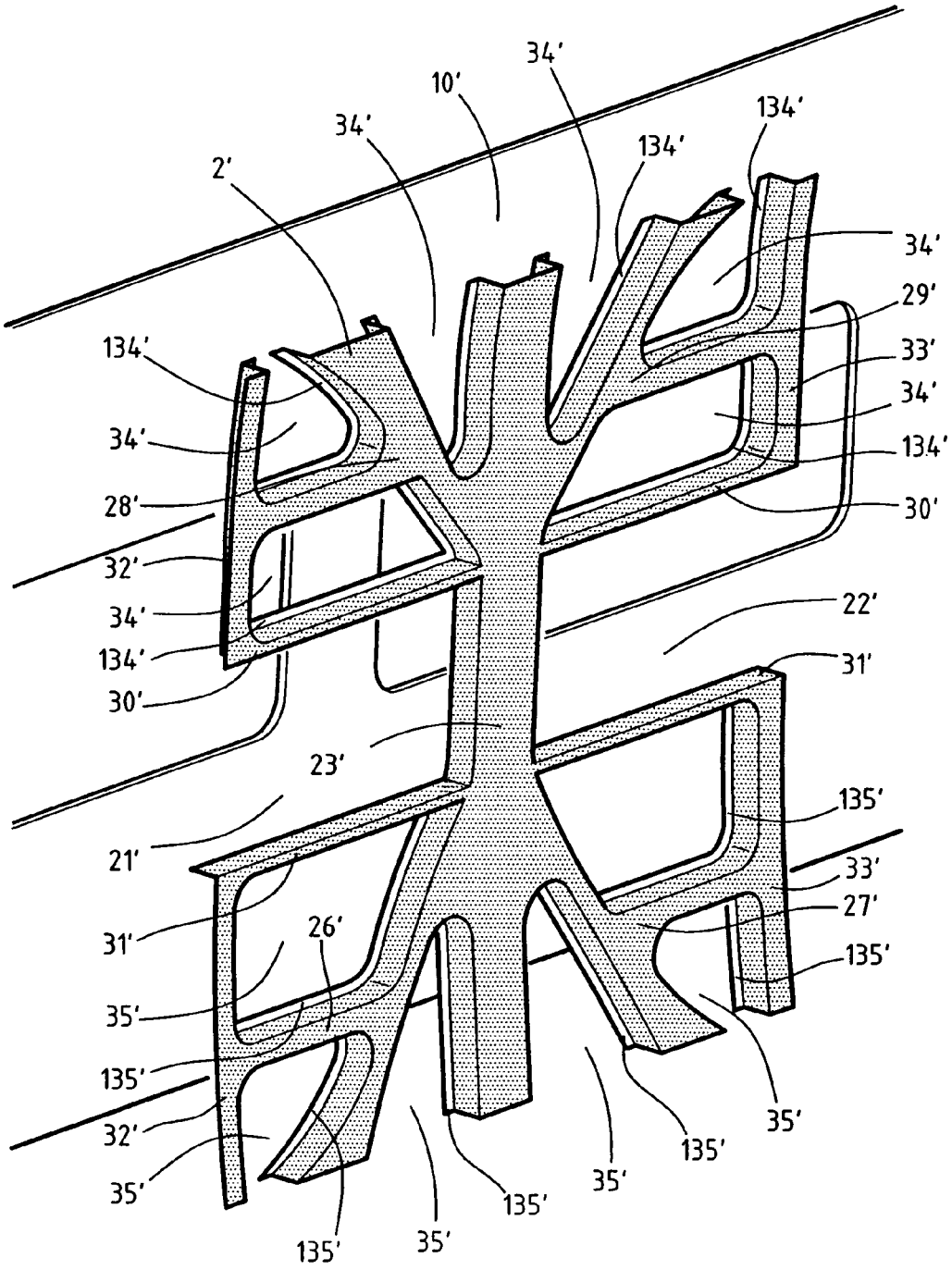
FIG. 6 is an exploded perspective view of a first production variant of a lateral face element of the body of a rail vehicle.

In a first production variant illustrated in FIG. 6, the outer skin 10' is bonded to a reinforcement panel 2' of the central panel type which includes an assembly of ribs which form a skeleton. This assembly of ribs includes in particular a main vertical rib 23' and horizontal ribs 30' and 31' which delimit recesses 21' and 22' which are intended to form windows, and complementary ribs such as the ribs 26' and 27' on the lower portion and 28' and 29' on the upper portion of the panel, providing a triangular arrangement in the shape of an "X". Generally, the ribs together delimit spaces which correspond to openings 34' and 35' in the upper and lower portions of the panel, delimited by edges 134' and 135' which are sufficiently wide to provide good adhesive-bonding for the skin. As in the above case, the panel includes vertical ribs 32' and 33' which provide the connection to the adjacent panels.

Figure 7:
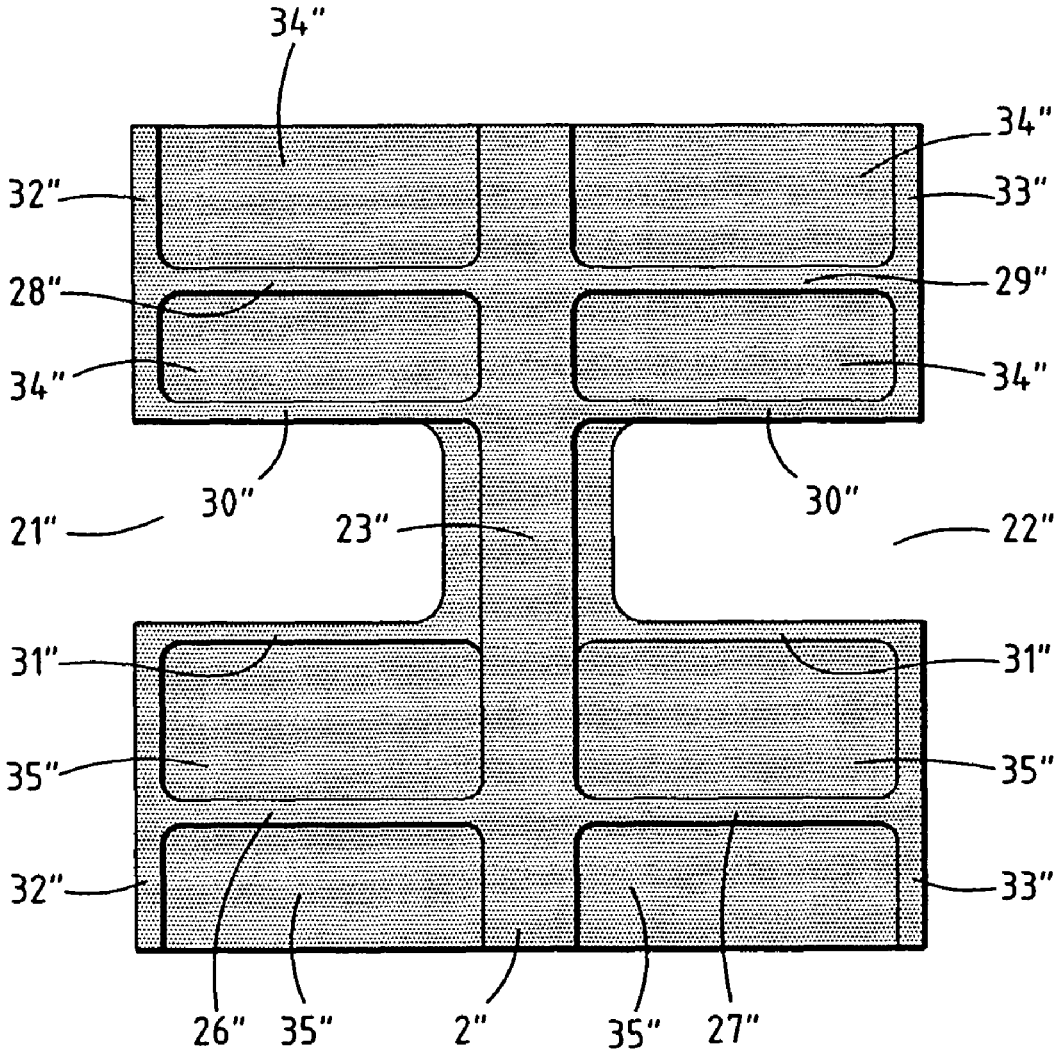
FIG. 7 is a schematic view of a second production variant of a lateral face element of the body of a rail vehicle.

In a second production variant, illustrated in FIG. 7, the panel 2", of the central panel type, is a solid panel which comprises recesses 21" and 22" which are intended to form windows. This panel includes a vertical rib 23" which extends over the entire height and which separates the two recesses 21" and 22" which are intended to form windows. The panel also includes horizontal ribs 30" and 31" which form a portion of the surround of the windows, and vertical ribs 32" and 33" which form the upper and lower portions of the lateral edges of the panel and which are intended to bring about the connection to the adjacent panels. In addition, the panel includes horizontal ribs 26", 27", 28", 29" in the lower and upper portions of the panel, but the panel does not include diagonal ribs which form a triangular reinforcement structure. The ribs together delimit cells 34" and 35" whose base is continuous.

Figure 8:
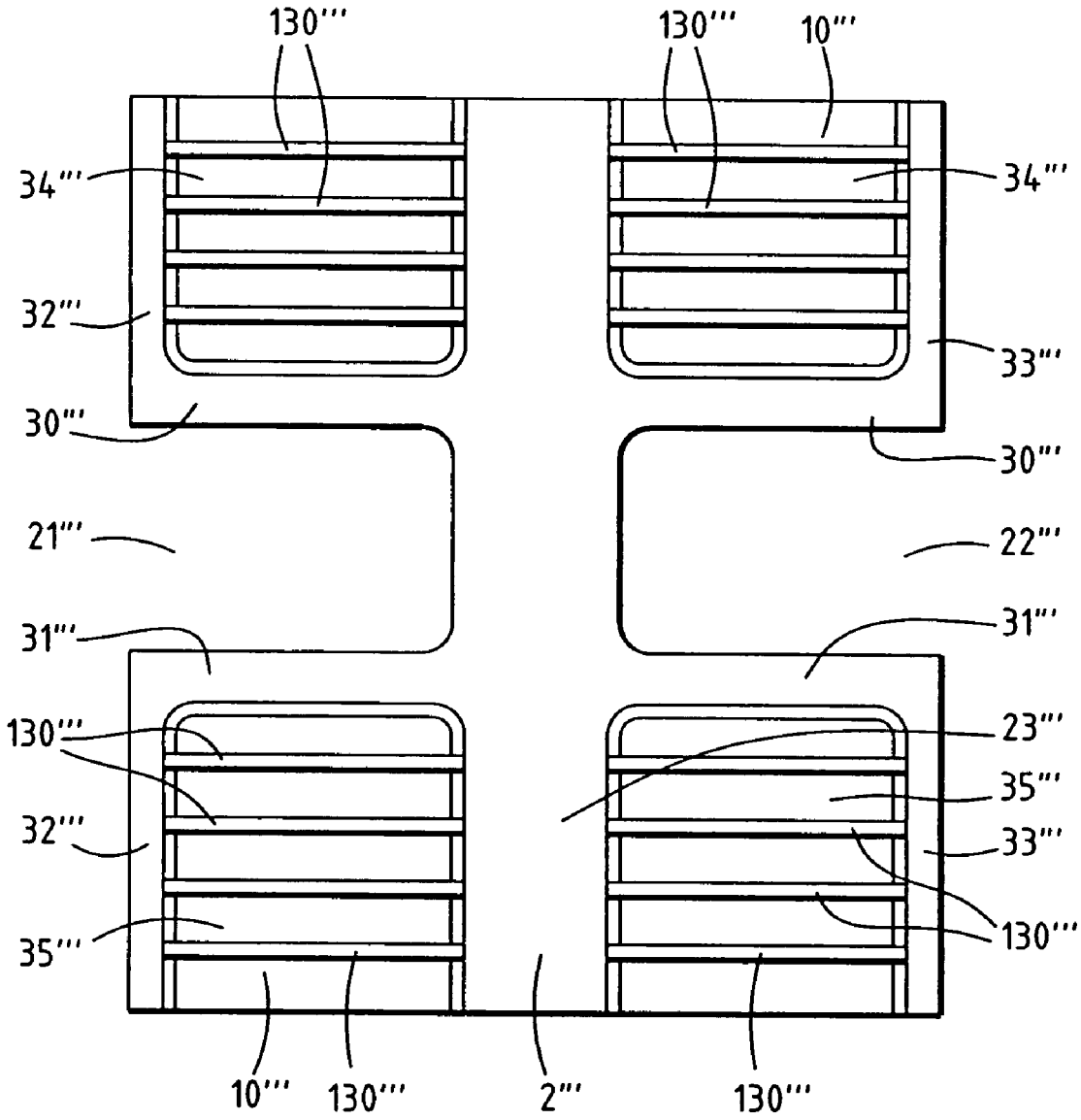
FIG. 8 is a schematic view of a third production variant of a lateral face element of the body of a rail vehicle.

In a third production variant which is illustrated in FIG. 8, the reinforcement panel 2''', of the central panel type, includes a main vertical rib 23''' which is complemented by horizontal ribs 30''' and 31''' which delimit recesses 21''' and 22''' which are intended to form windows, and by vertical ribs 32''' and 33''' which form the lateral edges of the panels, bringing about the connection to the adjacent panels.

All these ribs delimit openings 34''' and 35''' and form a skeleton to which the outer skin 10''' is adhesively-bonded.

Furthermore, in the spaces delimited by the ribs, longitudinal reinforcement beams 130''' which have a T-shaped cross-section, are adhesively-bonded to the skin and are fixedly joined to the panel 2''' by the ends thereof.

All the panels which have been described above may be any type of suitable material, and in particular materials which have already been mentioned. The panels can be produced using methods of moulding or pressing or can be mechanically welded. The panels may be shells which have thin walls and which include hollow ribs. The hollow ribs are open over the entire length thereof and include channels or chutes which can receive network elements for distribution of fluid, electricity or any type of signal. The spaces which are delimited by the ribs can be recessed, the panels then being skeletons. However, preferably, with the exception of the recesses which correspond to the openings such as windows, the spaces delimited by the ribs define cells whose bases include surfaces which allow effective adhesive-bonding of the outer skin.

By assembling panels as they have been described above, in particular a specific number of panels of the central type, and by complementing them at each end either with end panels or with door frame panels, it is possible to produce a framework for a lateral face of a rail vehicle body having the desired length. It is also possible, by arranging connection panels between central panels and panels of the door pillars, to arrange doors at a specific location over the length of the lateral face of the vehicle body, in particular a door may be half-way along or, on the other hand, close to one of the ends.

The two lateral faces of a body are almost symmetrical, relative to a plane, and cannot be superimposed. Consequently, it may be necessary to produce panels which are intended to produce a right-hand lateral face and panels which are produced for a left-hand lateral face. However, the person skilled in the art will know how to adapt the shape of the panels to what is required in order to be able to produce the two lateral faces of the rail vehicle body.

As will be appreciated, when a framework of a lateral face of a rail vehicle body has been produced by assembling panels and fixing them together by means of connection ribs, by means of welding, by means of riveting or adhesive-bonding, the lateral face is completed by adhesively-bonding the outer skin to the framework after having, if necessary, arranged in the ribs the networks which are intended to be concealed at that location. This outer skin thus provides excellent joining between all the panels and very effective sealing.

All the glazed panels 15 which are attached to the lateral face of the rail vehicle body in order to close the openings which correspond to the windows can also be positioned by means of adhesive-bonding or any other fixing means which are known to the person skilled in the art.

This embodiment of a lateral face of a rail vehicle body has the advantage, on the one hand, of being able to be adjusted, and, on the other hand, of allowing light faces to be constructed which are nonetheless very rigid and which have a good outward appearance and good sealing.

Since this method is suitable for producing rail vehicle faces for different models, using the same panels, it is possible to reduce production costs.

Preferably, the outer skin extends over the entire length of the lateral face of the rail vehicle body. However, the significant factor is that each connection between two adjacent panels is covered by the outer skin in order to seal this connection and strengthen the mechanical connection between the two panels. Therefore, in some configurations, the skin may extend over only a portion of the length of the lateral face.

Furthermore, in order to provide a good level of mechanical strength, in particular in terms of fatigue, of the lateral face, the connection of two adjacent panels must not open in a zone of concentrated stress which corresponds to an irregularity in terms of shape of the lateral face. To this end, it is preferable for the panels to extend over the entire height of the lateral face.

In particular, owing to the design of the panels as described above, any opening is delimited by a maximum of two panels and the connection between two central panels which delimit a window is formed in the centre of the windows and not in the corners of the windows which are zones of concentrated stress, that leads to better mechanical strength for the walls in the region of the corners of the windows. These zones are inside panels and their shapes can be adapted in order to provide the best mechanical behaviour possible for the window corners. This results in better strength for the rail vehicle body lateral faces.

The panels as they have been described above may include one possible embodiment of the panels for producing rail vehicle body lateral faces. However, the person skilled in the art will appreciate that he can produce panels having different shapes, including sheets which are shaped so as to have hollow reinforcement ribs which protrude towards the inner side of the body of the rail vehicle and which preferably together delimit cells whose faces form large surfaces to provide effective adhesive-bonding of an outer skin, the cells being able to receive insulating materials. The person skilled in the art will know how to select the rib shape suitable for producing reinforcement structures which may or may not be triangular. He will also know how to select the most suitable material and assembly method in each case.

Finally, the person skilled in the art will appreciate that he can produce, using the technique which has been described above, rail vehicle body lateral faces which do not include openings over the entire length thereof or which do not even include any openings at all.

To this end, it is sufficient for the outer skin not to include any opening in the zones in question and for the reinforcement panels to be optionally adapted as a result.

The person skilled in the art will also be able to provide panels which do not extend over the entire height of the lateral face of the rail vehicle and which include, for example, horizontal connections. However, preferably, these connections must not open in zones of concentrated stress.

The invention claimed is:

1. A lateral face of a rail vehicle body comprising:

a framework including an assembly of a plurality of adjacent panels, each of the plurality of adjacent panels including ribs; and an outer skin adhesively-bonded to the framework and extending over at least two adjacent panels to extend over an entire length of the lateral face;

the assembly of panels and the outer skin together forming a laminated assembly, the ribs arranged for ensuring vertical rigidity and horizontal rigidity of the lateral face, the ribs including horizontal and vertical ribs, horizontal and vertical ribs of two adjacent panels forming at least one opening for a window, the two adjacent panels having a connection located away from a zone of concentrated stress corresponding to corners of the at least one opening, at least one of the panels including two recesses forming two half-windows, the ribs including a core, the core being a lateral pillar of at least one window and common to the two half-windows, one of the half-windows being part of the at least one window, at least one rib diagonally extending from the core to an upper edge of the at least one panel and at least one further rib diagonally extending from the core to a lower edge of the at least one panel, the at least one rib and at least one further rib forming at least one X-shaped reinforcement structure including the core.

2. The lateral face of a rail vehicle body as recited in claim 1 wherein each of the plurality of adjacent panels extends over an entire height of the lateral face.

3. The lateral face of a rail vehicle body as recited in claim 1 wherein the horizontal and vertical ribs form at least one opening for a door of a single panel or two adjacent panels, the two adjacent panels having a connection located away from a plurality of zones of concentrated stress corresponding to corners of the at least one opening.

4. The lateral face of a rail vehicle body as recited in claim 1 further comprising at least one glazed panel for closing a window on an outside of the lateral face.

5. The lateral face of a rail vehicle body as recited in claim 1 wherein two adjacent panels being connected by mutually complementary vertical ribs of the ribs or rib portions of the ribs on vertical edges of the two adjacent panels.

6. The lateral face of a rail vehicle body as recited in claim 1 wherein at least one panel of the panels includes at least one opening through a space delimited by the ribs, the opening concealed by the outer skin.

7. The lateral face of a rail vehicle body as recited in claim 6 further comprising at least one horizontal longitudinal beam secured to the outer skin extending in the at least one opening delimited by the ribs and fixedly joined to the outer skin, the panel including the opening.

8. The lateral face of a rail vehicle body as recited in claim 1 wherein at least one panel of the panels is a ribbed shell having the ribs that together define at least one cell having a continuous base.

9. The lateral face of a rail vehicle body as recited in claim 8 wherein at least one of the ribs that together define at least one cell includes a thermal or acoustic insulation material.

10. The lateral face of a rail vehicle body as recited in claim 1 further comprising an inner cover wall on an inner side of the lateral face.

11. The lateral face of a rail vehicle body as recited in claim 1 wherein at least one panel of the panels receives a door, the ribs being at least lateral pillars of the door.

12. The lateral face of a rail vehicle body as recited in claim 1 wherein at least one network including a ventilation sheath, heating sheath, electrical cables or fluid distribution, is in a space delimited by the outer skin and at least one rib of the ribs of the at least one panel.

13. The lateral face of a rail vehicle body as recited in claim 1 wherein the at least one panel of the panels is a plate of composite material including a network of fibers impregnated with a resin and shaped by moulding or the at least one panel is a cut and pressed metal plate.

14. The lateral face of a rail vehicle body as recited in claim 1 wherein the outer skin is a sheet cut to form openings, and is composed of composite material, metal or plastics material.

15. The lateral face of a rail vehicle body as recited in claim 1 wherein the panels or the outer skin is assembled by adhesive-bonding, riveting, bolting, adhesive-bonding and riveting, adhesive-bonding and bolting, clinching or welding.

16. A rail vehicle comprising the rail vehicle body, the rail vehicle body including the lateral face as recited in claim 1.

17. The rail vehicle as recited in claim 16 wherein the rail vehicle is a carriage.

18. A composite or pressed metal panel for the lateral face of the rail vehicle body as recited in claim 1.

* * * * *